US005239929A

United States Patent [19]

Nilsson et al.

[11] Patent Number: 5,239,929

[45] Date of Patent: Aug. 31, 1993

[54] METHOD AND AN APPARATUS FOR SEALING AN EXPLOSIVE CHARGE COMPARTMENT IN A SHELL

[75] Inventors: Stig Nilsson, Atorp; Jan Fixell; Klas Larsson, both of Karlskoga, all of Sweden

[73] Assignee: Bofors AB, Karlskoga, Sweden

[21] Appl. No.: 899,911

[22] Filed: Jun. 17, 1992

[30] Foreign Application Priority Data

Jun. 18, 1991 [SE] Sweden ..... 9101876

[51] Int. Cl.[5] ..... F42B 12/00

[52] U.S. Cl. ..... 102/473; 102/293; 102/499

[58] Field of Search ..... 102/293, 306–310, 102/473, 476, 499, 500; 29/1.2–1.23; 86/20.14

[56] References Cited

U.S. PATENT DOCUMENTS 4,945,834 8/1990 Young ..... 102/473
4,945,835 8/1990 Gunter et al. ..... 102/476
5,133,259 7/1992 Schluchebier ..... 102/473

FOREIGN PATENT DOCUMENTS 3838581 5/1990 Fed. Rep. of Germany ..... 102/476
545315 8/1957 Italy ..... 102/473

OTHER PUBLICATIONS

*The Condensed Chemical Dictionary*, Eighth Ed. 1971, p. 784.

*Primary Examiner*—Harold J. Tudor
*Attorney, Agent, or Firm*—Pollock, Vande Sande & Priddy

[57] ABSTRACT

A device and method are provided for sealing off an explosive charge compartment in a shell of the type in which the shell includes a shell case at its forward region and an element which is inserted into said shell case to cover an explosive charge and is provided with an outer annular abutment surface abutting against the inner contour of the shell case. The device includes a strand of sealant compound which is applied at least along an edge of the upper end portion of the element covering the explosive charge and a radially expendable ring which is forced by radial flaring against the sealant compound to straddle at least a joint between the edge of the upper end portion of the covering element and the inner contour of the shell case to accurately follow inner contours of the element and the shell case.

15 Claims, 1 Drawing Sheet

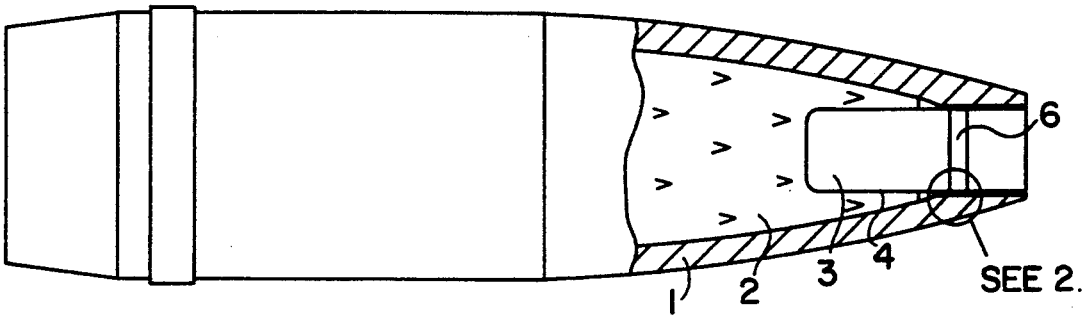
FIG. 1
FIG. 2
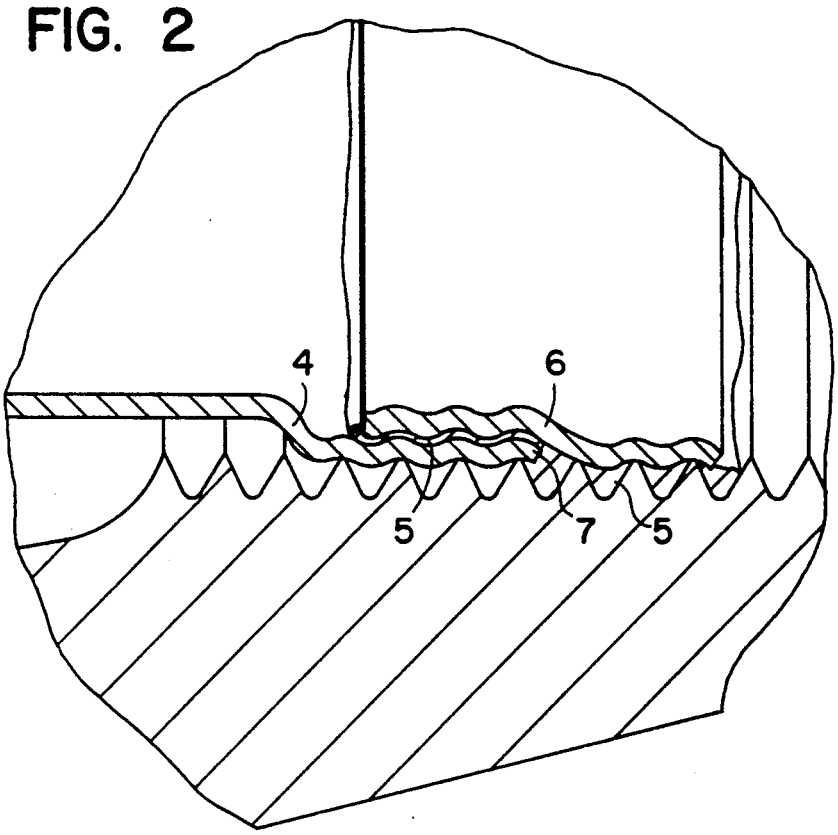

METHOD AND AN APPARATUS FOR SEALING AN EXPLOSIVE CHARGE COMPARTMENT IN A SHELL

FIELD OF THE INVENTION

The present invention relates to a method and an apparatus for sealing off the explosive charge compartment in a shell of the type in which the shell comprises a shell case in whose forward region there is disposed an element covering the explosive charge and provided with an annular abutment surface against the inner contour of the shell case.

BACKGROUND OF THE INVENTION

The maximum discharge and storage temperature for conventional explosive shells is often limited by the properties of their TNT or TNT-based explosive charge. At sufficiently elevated temperature, this secretes an exudate which may be sucked into capillary gaps in, for example, the thread connection between fuze and shell case. When the temperature once again falls, the exudate crystallizes in the gap to solid form. The high load to which the material in the supporting parts of the shell is exposed during the barrel phase on firing causes minor movements between them. These movements occur as a result of the deformation of the material and, for example, by releasing the pretension of the threads and the tightening of the connection on angular acceleration of the shell. The frictional heat which is generated on movement of the shell parts towards one another is often sufficient to ignite the exudate so that the shell bursts in the barrel. In such instance, the gun will be damaged and the safety of the gun crew put at great jeopardy. In order to avoid this course of events, a maximum firing and storage temperature for the shells is normally adopted, or else the shell is designed with requisite seals about the explosive charge compartment.

SUMMARY OF THE INVENTION

As a result of stricter requirements with respect to safety and maximum firing temperature in military munitions, older designs need to be improved and contingency-stocked ammunition reviewed. One object of the present invention is, therefore, to provide a sealing of the explosive charge compartment in existing shells of the above-mentioned type. This may be achieved according to the present invention with minimal resources, since the modification in design merely implies a retrofitting with a space-saving seal which requires no processing of the existing structure. Consequently, relatively expensive type-testing and approval need only be supplemented, and modification of existing shells requires no advanced workshop equipment, but can be carried out in the vicinity of the military stores, enabling transport and other tasks that are to be avoided from the safety standpoint.

Those shells which may ideally be improved using the present invention are fitted with a detonator between the fuze and the explosive charge, with the detonator sunk into the explosive charge. The recess for the detonator in the explosive charge is lined with a metal can which is often positionally fixed by being pressed in place at the opening against the shell case without having a sealing function. Shells of other design may often benefit from the advantages of the present invention at low overall cost after being retrofitted, for example, by being fitted with an element covering the explosive charge similarly to the metal can, as described above. A further object of the present invention is, therefore, to provide an apparatus for sealing the above-described metal can against the shell case so that no exudate may penetrate through the joint. The element must also reinforce the edge of the can and be of such mechanical strength that the volume increase of the TNT on passage of the recrystallization temperature does not ruin the sealing function, even if the other parts of the metal can are then deformed. The sealing element must be so small as not to encroach upon the space requirements of other components. It must also satisfy those requirements of functional dependability and aging which are always imposed on critical parts from the safety standpoint.

This is achieved according to the present invention by applying a strand of sealing compound at the edge of the element covering the explosive charge, whereafter a ring, preferably of metal, is pressed by radial flaring against the sealing compound so as to straddle the edge (the joint) between the element covering the explosive charge and the shell case, and accurately follow the inner contours of the element covering the explosive charge and the shell case.

According to one preferred embodiment of the present invention, the element covering the explosive charge consists of a metal can sunk into the explosive charge and forming a housing for a detonator for the explosive charge.

BRIEF DESCRIPTION OF THE ACCOMPANYING DRAWINGS

The nature of the present invention and its aspects will be more readily understood from the following brief description of the accompanying Drawings, and discussion relating thereto. In the accompanying Drawings:

FIG. 1 shows a shell in which the present invention is applied; and

FIG. 2 shows an enlargement of the sealing device.

DESCRIPTION OF PREFERRED EMBODIMENT

The shell may, for example, consist of a 155 mm artillery shell, having a case 1 which surrounds an explosive charge 2. Forwardly in the shell, there is a compartment or recess 3 for a detonator and a fuze. The compartment or recess 3 is lined with a metal can 4 which has been pressed into place against the inner wall of the shell case, as described above.

The inventive concept is to lay a strand of drying or curing rubber or plastic 5 at the edge of the can and thereafter mount a thin metal ring 6 which straddles the edge 7 and which closely follows the contours of the can and the shell case. The ring will then impart mechanically stability, positional fixing and strength to the seal. At the same time, the rubber or plastic will provide the final sealing where it has been pressed out into and fills the remaining capillary gap between the components, then cured or dried. Fixing of the components to one another is effected in that the ring follows the surface of the other parts so closely that their natural unevenness will provide retention forces. These increase if the ring can be mounted, for example, in the final turn of the fuze thread as in the figure, or in an existing ledge.

According to one preferred embodiment of the seal, the ring 6 is made in such small diameter that it may readily be inserted into the shell in a position above the joint and a silicon rubber strand be laid in the joint. Thereafter, the ring is radially flared into abutment against the outer parts, the silicon rubber being simultaneously spread and filling out the remaining cavities. The material properties of the ring must permit large plastic deformation and allow slight resilience after mounting in place, such as, for example, low-alloyed aluminium.

A suitable tool for the mounting operation is provided with a rubber cylinder which, by axial compression, expands and forces the ring radially outwardly, using the shell case and metal can as dolly. The elasticity of the rubber cylinder forces the ring to pliantly shape itself according to these.

The present invention should not be considered as restricted to that described above and shown on the Drawings, many modifications being conceivable without departing from the spirit and scope of the appended claims.

What we claim and desire to secure by Letters Patent is:

1. A method for sealing off an explosive charge compartment in a shell of the type in which the shell includes a shell case and an element which is inserted into a forward region of said shell case to cover an explosive charge, said element being provided with an outer annular abutment surface at least at an upper end portion of said element abutting against an inner contour of the shell case, said method comprising the steps of:

applying a strand of sealant compound at least along an edge of said upper end portion of said element; and forcing a radially expendable ring by radial flaring against the sealant compound to straddle at least a joint between said edge of said upper end portion of said element and said inner contour of said shell case and to accurately follow inner contours of said element and said shell case.

2. A method as claimed in claim 1, wherein said ring is made of radially expendable metal.

3. A method as claimed in claim 1, wherein said element covering the explosive charge comprises a metal can sunk into the explosive charge and forming a housing or lining for a detonator for the explosive charge.

4. A method as claimed in claim 1, wherein said sealant compound comprises a strand of dried rubber.

5. A method as claimed in claim 1, wherein said ring is made of a material which permits large plastic deformation and which allows for a slight resilience after being mounted in place in said shell case.

6. An apparatus for sealing off an explosive charge compartment in a shell of the type in which the shell includes a shell case and an element which is inserted into a forward region of said shell case to cover an explosive charge, said element being provided with an outer annular abutment surface abutting against the inner contour of the shell case, at least along an upper end portion of said element, said apparatus comprising:

a strand of sealant compound applied at least along an edge of said upper end portion of said element covering the explosive charge; and a radially expendable ring forced by radial flaring against the sealant compound to straddle at least an edge joint between said edge of said upper end portion of said element and said inner contour of said shell case and to accurately follow inner contours of said element and said shell case.

7. An apparatus as claimed in claim 6, wherein said ring is made of radially expendable metal.

8. An apparatus as claimed in claim 6, wherein said element covering the explosive charge comprises a metal can sunk into the explosive charge and forming a housing or lining for a detonator for the explosive charge.

9. Apparatus as claimed in claim 6, wherein said sealant compound comprises a strand of dried rubber.

10. Apparatus as claimed in claim 6, wherein said sealant compound comprises a strand of plastic.

11. Apparatus as claimed in claim 6, wherein said sealant compound is a silicon rubber strand.

12. Apparatus as claimed in claim 6, wherein said ring is mounted at the location of the fuse thread of said shell case.

13. Apparatus as claimed in claim 6, wherein said ring comprises a strand of cured rubber.

14. Apparatus as claimed in claim 6, wherein said ring is made of a material which permits large plastic deformation and which allows for a slight resilience after being mounted in place in said shell case.

15. Apparatus as claimed in claim 6, wherein said ring is made of low-alloy aluminum.

* * * * *